US010743698B1

(12) United States Patent
Chen

(10) Patent No.: US 10,743,698 B1
(45) Date of Patent: Aug. 18, 2020

(54) CURTAIN TRACK ASSEMBLY

(71) Applicant: My Home Global Company, Taichung (TW)

(72) Inventor: Chi-Cha Chen, ErShui Township (TW)

(73) Assignee: My Home Global Company, Taichung (TW)

( * ) Notice: Subject to any disclaimer, the term of this patent is extended or adjusted under 35 U.S.C. 154(b) by 0 days.

(21) Appl. No.: 16/385,093

(22) Filed: Apr. 16, 2019

(51) Int. Cl.

| | |
|---|---|
| ***A47H 15/00*** | (2006.01) |
| ***A47H 1/08*** | (2006.01) |
| ***A47H 15/02*** | (2006.01) |
| *A47H 1/04* | (2006.01) |

(52) U.S. Cl.
CPC ..... *A47H 1/08* (2013.01); *A47H 15/02* (2013.01); *A47H 2001/047* (2013.01)

(58) Field of Classification Search
CPC ..... E05F 5/003; E05F 5/10; E05F 1/16; E05F 3/00; E05F 3/02; E05F 3/04; E05F 3/16; E05F 3/18; E05F 1/00; E05F 1/02; E05F 1/046; E05Y 2900/20; E05Y 2800/24; E05Y 2201/408; E05Y 2201/412; E05Y 2201/46; E05Y 2201/418; E05Y 2201/638; E05Y 2201/684; E05Y 2201/218; E05Y 2201/224; E05Y 2201/212; E05Y 2900/132; E05D 15/063; E05D 15/0621; E05D 15/0652; E05D 15/0686; E05D 15/565; E05D 15/0647; E05D 15/0678; A47H 1/08; A47H 15/02; A47H 15/04; A47H 2001/047; Y10T 16/35; Y10T 16/354; Y10T 16/373; Y10T 16/375; Y10T 16/379; Y10T 16/3797
See application file for complete search history.

(56) References Cited

U.S. PATENT DOCUMENTS

| | | | | | |
|---|---|---|---|---|---|
| 2,757,804 | A * | 8/1956 | Sadwin | A47B 61/02 | 211/94.01 |
| 3,314,100 | A * | 4/1967 | Znamirowski | A47H 15/02 | 16/87.4 R |
| 3,344,463 | A * | 10/1967 | Znamirowski | A47H 1/104 | 16/94 D |
| 3,348,603 | A * | 10/1967 | Ford | E06B 3/4609 | 160/197 |
| 3,431,585 | A * | 3/1969 | Foltz | E05D 15/0652 | 16/94 D |

(Continued)

FOREIGN PATENT DOCUMENTS

| | | | | |
|---|---|---|---|---|
| DE | 4120511 | A1 * | 12/1992 | A47H 1/08 |

*Primary Examiner* — Chuck Y Mah
(74) *Attorney, Agent, or Firm* — Alan D. Kamrath; Mayer & Williams PC

(57) ABSTRACT

A curtain track assembly includes a base, a plurality of tracks, and two slides. The base is provided with a plurality of slots. Each of the slots of the base includes a receiving section, two side openings, and a lower opening. The tracks extend through the slots of the base, and the base is secured on each of the tracks. Each of the tracks includes a receiving section, two side openings, and a lower opening. Each of the two slides is provided with a plurality of mounting portions slidably mounted on the tracks. Each of the mounting portions of each of the two slides includes a receiving section, at least one side opening, and a lower opening. Thus, the two slides are moved in two directions during the assembling process to expand or retract the curtain track assembly.

10 Claims, 10 Drawing Sheets

(56) References Cited

U.S. PATENT DOCUMENTS

| | | | | | |
|---|---|---|---|---|---|
| 3,975,792 | A * | 8/1976 | Janson | A47H 1/06 | 16/87.4 R |
| 4,581,788 | A * | 4/1986 | Baumann | A47H 1/08 | 16/93 D |
| 4,694,531 | A * | 9/1987 | Foy | A47H 1/144 | 104/111 |
| 4,733,435 | A * | 3/1988 | Darner | A47H 15/02 | 16/87.4 R |
| 4,935,988 | A * | 6/1990 | Ford | A47H 1/02 | 16/87.4 R |
| 5,109,910 | A * | 5/1992 | Tortorella | A47H 15/04 | 160/97 |
| 5,791,394 | A * | 8/1998 | Huang | A47H 1/08 | 16/95 D |
| 7,043,795 | B2 * | 5/2006 | Bosgoed | A47H 1/04 | 16/211 |
| 7,270,165 | B1 * | 9/2007 | Chuang | E05D 15/0647 | 160/197 |
| 7,284,587 | B2 * | 10/2007 | Nien | E06B 9/264 | 160/84.01 |
| 7,299,852 | B1 * | 11/2007 | Chuang | A47H 15/04 | 160/197 |
| 8,297,334 | B2 * | 10/2012 | Chu | E06B 9/36 | 160/222 |
| 9,051,774 | B1 * | 6/2015 | Acker, Jr. | E05D 15/0626 | |
| 9,585,508 | B2 * | 3/2017 | Graneto, III | A47H 1/04 | |
| 10,307,007 | B2 * | 6/2019 | Thomas | A47H 1/08 | |
| 10,517,418 | B2 * | 12/2019 | Wu | A47H 1/124 | |
| 2011/0030169 | A1 * | 2/2011 | Aebi | A47H 1/04 | 16/87.4 R |
| 2011/0191983 | A1 * | 8/2011 | Chen | A47H 1/08 | 16/87.2 |
| 2013/0167326 | A1 * | 7/2013 | Rowan | A47H 1/04 | 16/94 D |

* cited by examiner

CURTAIN TRACK ASSEMBLY

BACKGROUND OF THE INVENTION

1. Field of the Invention

The present invention relates to a track and, more particularly, to a track assembly for a window covering, such as a curtain, a blind, a shade or the like.

2. Description of the Related Art

A conventional curtain is moved transversely on a track which is fixed at a predetermined position. However, the track has a constant length that cannot be adjusted according to the user's practice requirement. A retractable curtain track includes a sliding rail that is expanded or retracted in a single direction. Thus, the curtain track has a larger area of assembly, thereby facilitating the user mounting the curtain track. However, the expanded sliding rail is easily bent or deformed due to the gravity of the curtain, thereby affecting movement of the curtain. In addition, the sliding rail is folded and unfolded in one direction, thereby decreasing the aesthetic quality of the curtain track.

BRIEF SUMMARY OF THE INVENTION

The primary objective of the present invention is to provide a curtain track assembly having a bidirectional adjusting function.

In accordance with the present invention, there is provided a track assembly comprising a base, a plurality of tracks connected with the base, and two slides slidably mounted on the tracks. The base is provided with a plurality of slots. Each of the slots of the base includes a receiving section, two side openings, and a lower opening. The receiving section of each of the slots defines two mounting areas. The lower opening of each of the slots has two fitting ends. The tracks extend through the slots of the base, and the base is secured on each of the tracks. Each of the tracks includes a receiving section, two side openings, and a lower opening. The lower opening of each of the tracks has two fitting ends mounted in the two mounting areas of each of the slots. Each of the two slides is provided with a plurality of mounting portions slidably mounted on the tracks. Each of the mounting portions of each of the two slides includes a receiving section, at least one side opening, and a lower opening. The receiving section of each of the mounting portions of each of the two slides defines two sliding areas mounted on the two fitting ends of each of the tracks. The tracks extend through the mounting portions of each of the two slides. The lower opening of each of the mounting portions of each of the two slides has two sliding ends. Each of the tracks is provided with two stop portions, and each of the mounting portions of each of the two slides is provided with a resting portion that is movable to touch one of the two stop portions of each of the tracks. The receiving section of each of the mounting portions of each of the two slides is provided with an operation space.

According to the primary advantage of the present invention, the two slides are moved in two directions during the assembling process so as to expand or retract the curtain track assembly according to the user's requirement.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
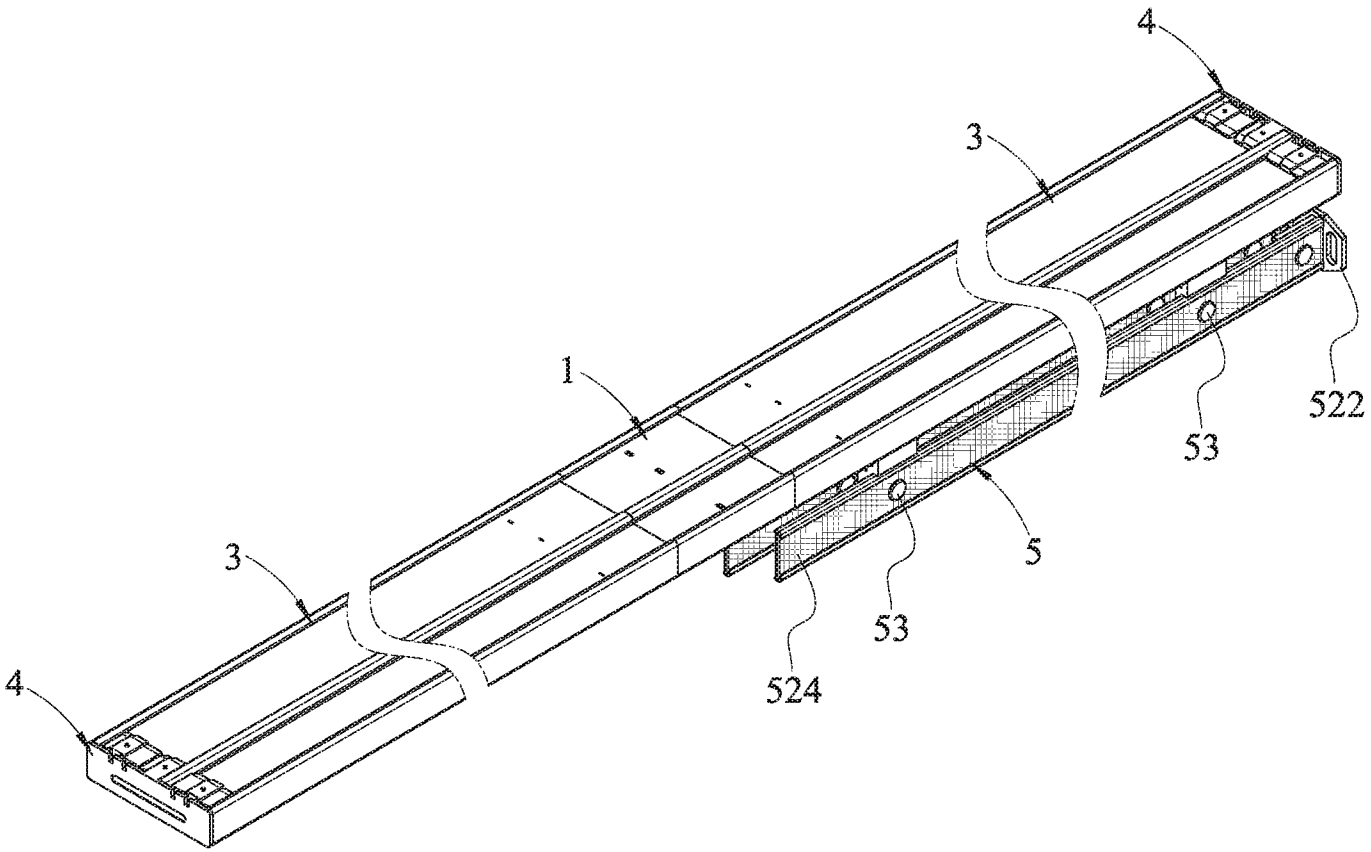
FIG. 1 is a perspective view of a track assembly in accordance with the preferred embodiment of the present invention.
Figure 2:
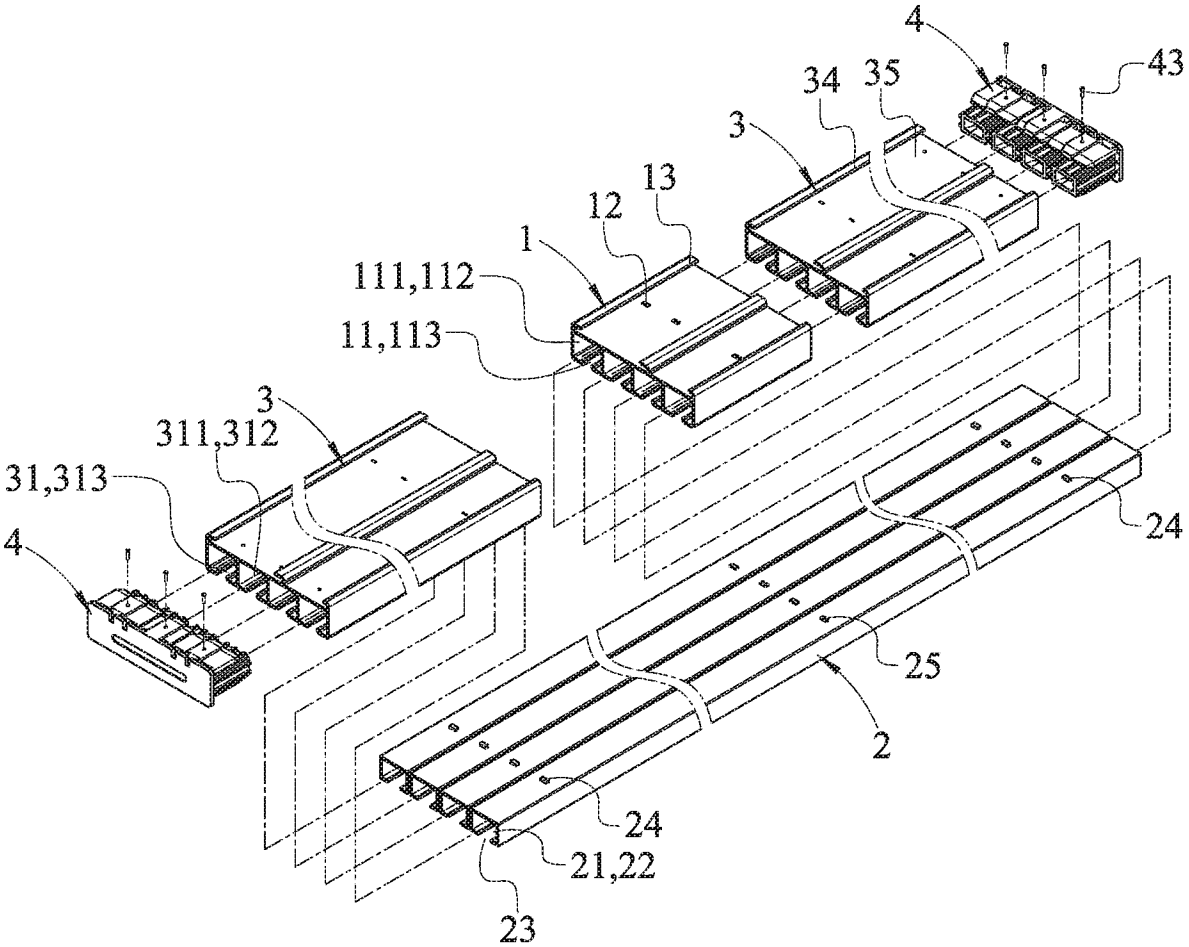
FIG. 2 is a partial exploded perspective view of the track assembly in accordance with the preferred embodiment of the present invention.
Figure 3:
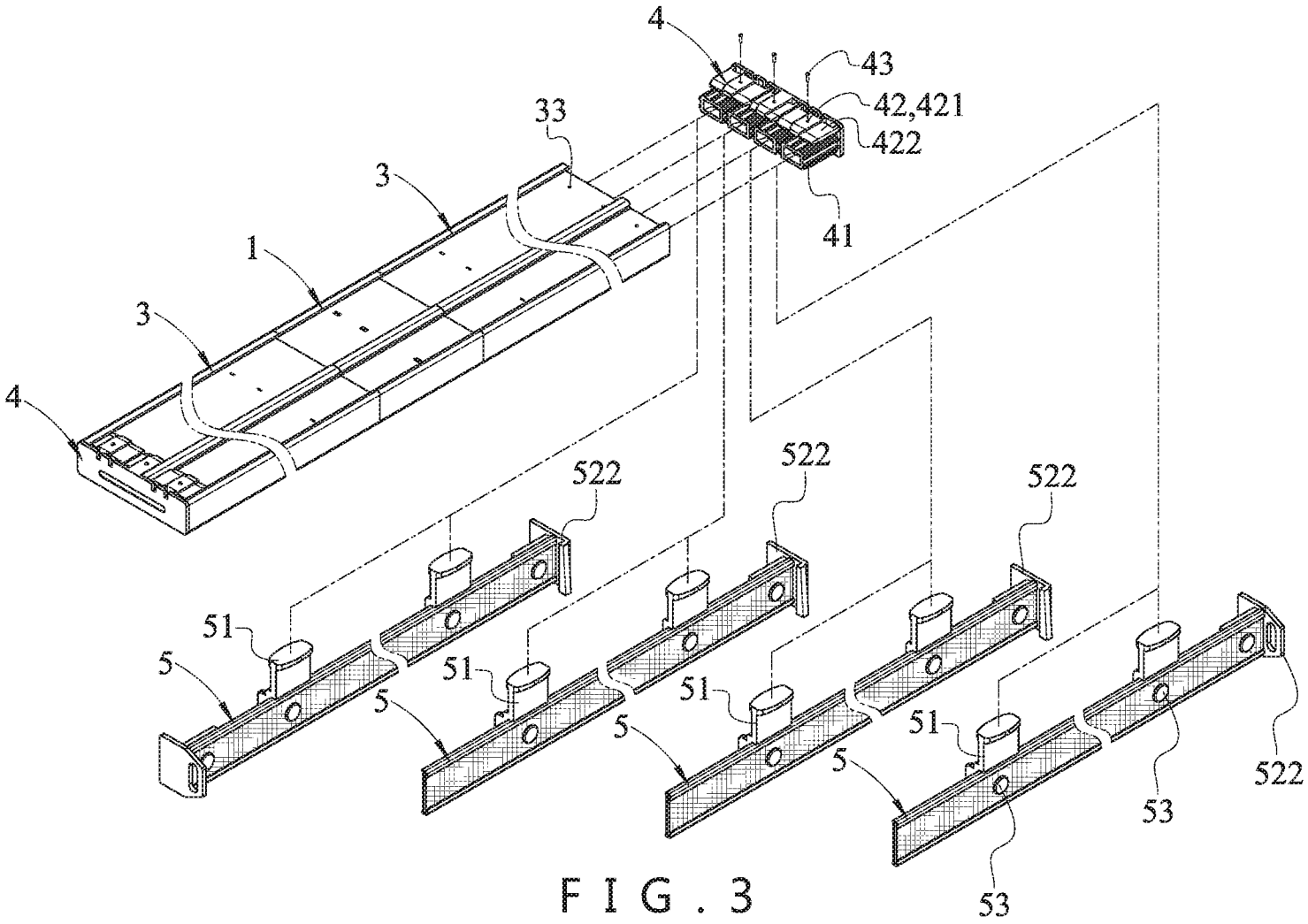
FIG. 3 is another partial exploded perspective view of the track assembly in accordance with the preferred embodiment of the present invention.
Figure 4:
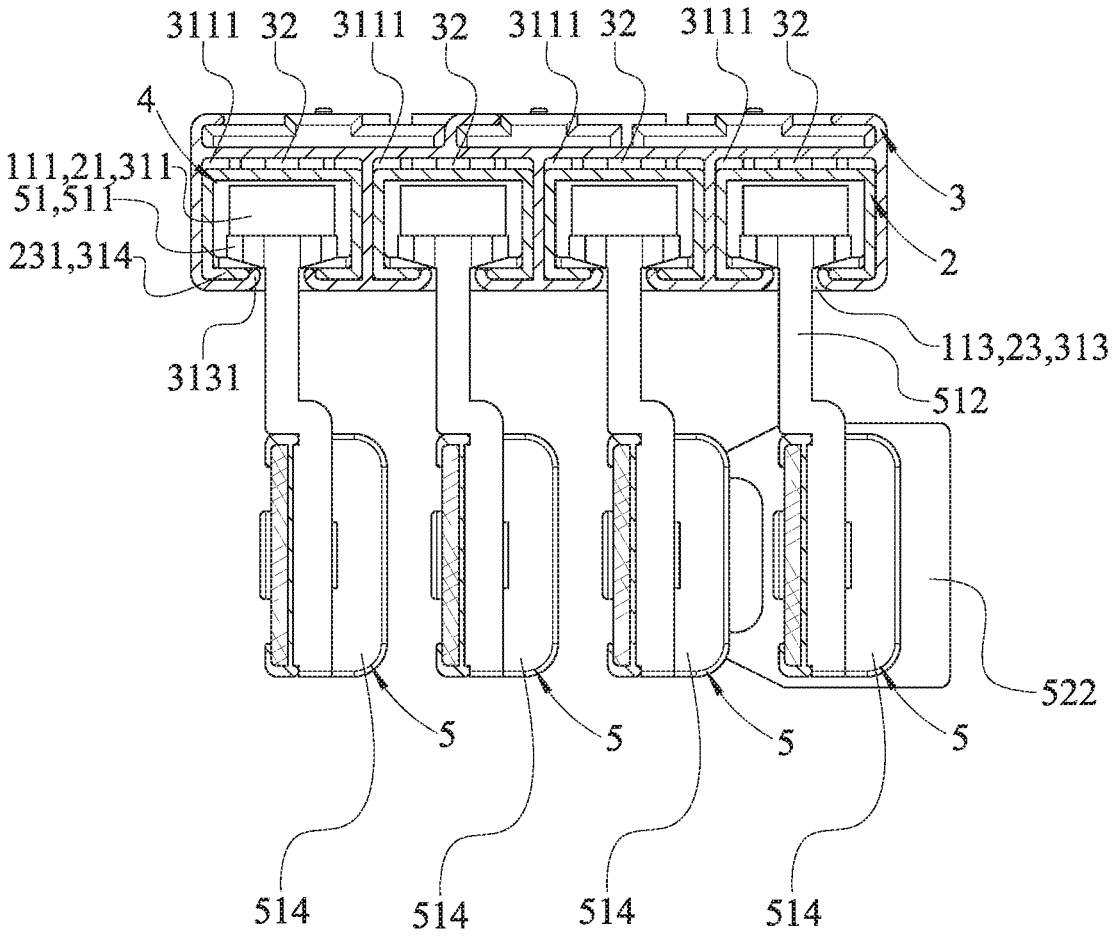
FIG. 4 is a side cross-sectional view of the track assembly in accordance with the preferred embodiment of the present invention.
Figure 5:
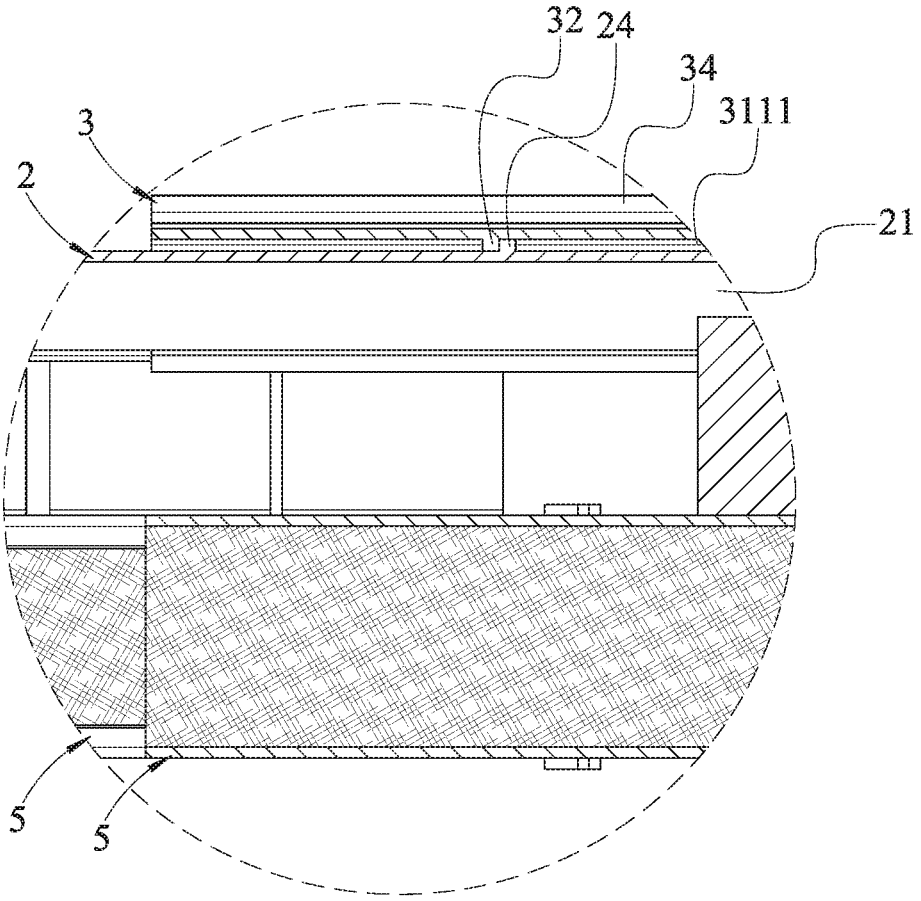
FIG. 5 is a locally enlarged cross-sectional view of the track assembly in accordance with the preferred embodiment of the present invention.
Figure 6:
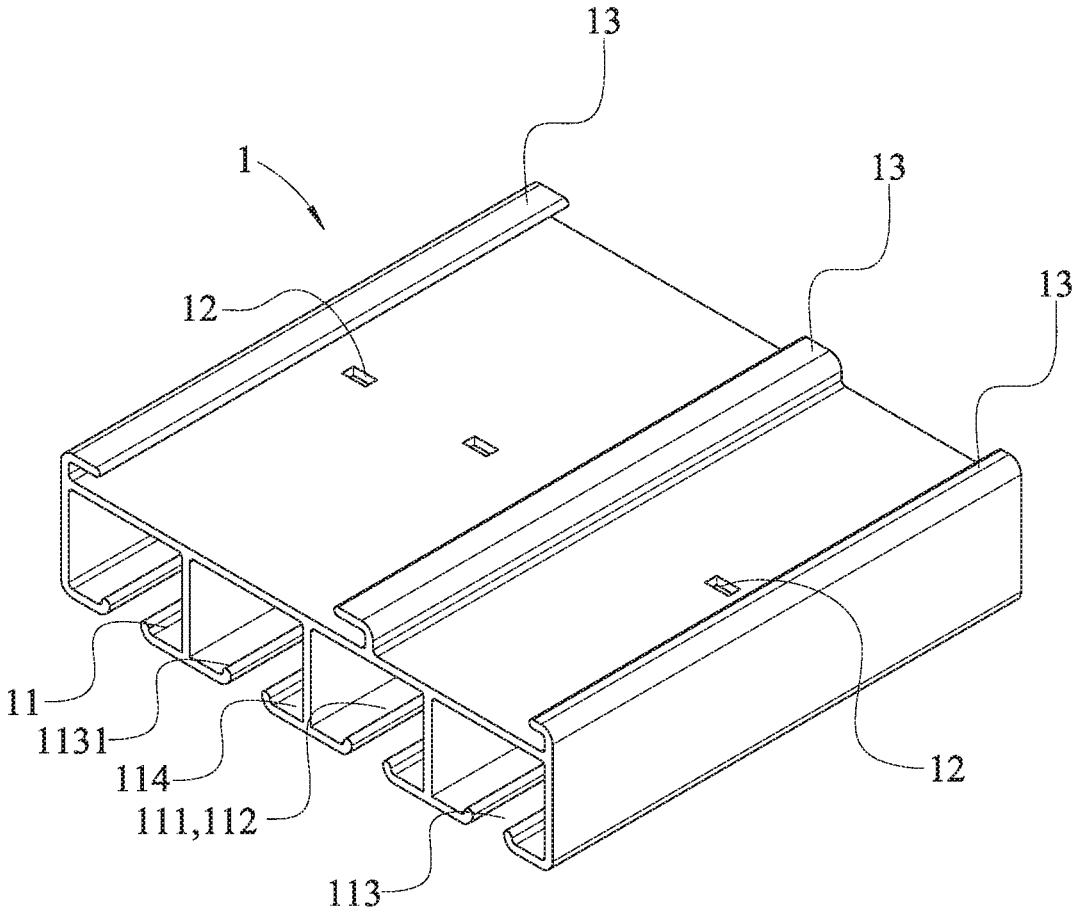
FIG. 6 is a perspective view of a base of the track assembly in accordance with the preferred embodiment of the present invention.
Figure 7:
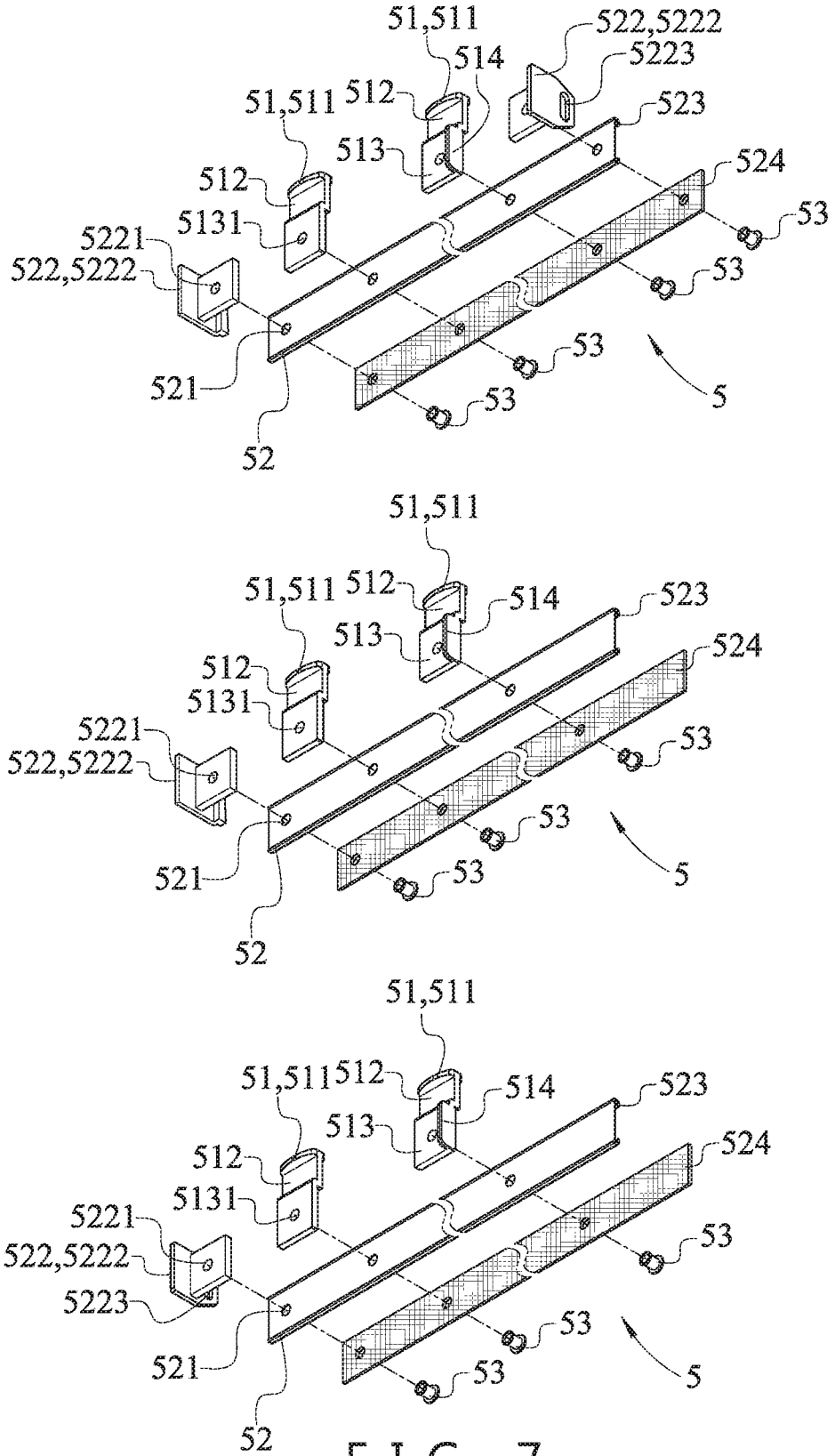
FIG. 7 is an exploded perspective view of a plurality of sliding seats of the track assembly in accordance with the preferred embodiment of the present invention.
Figure 8:
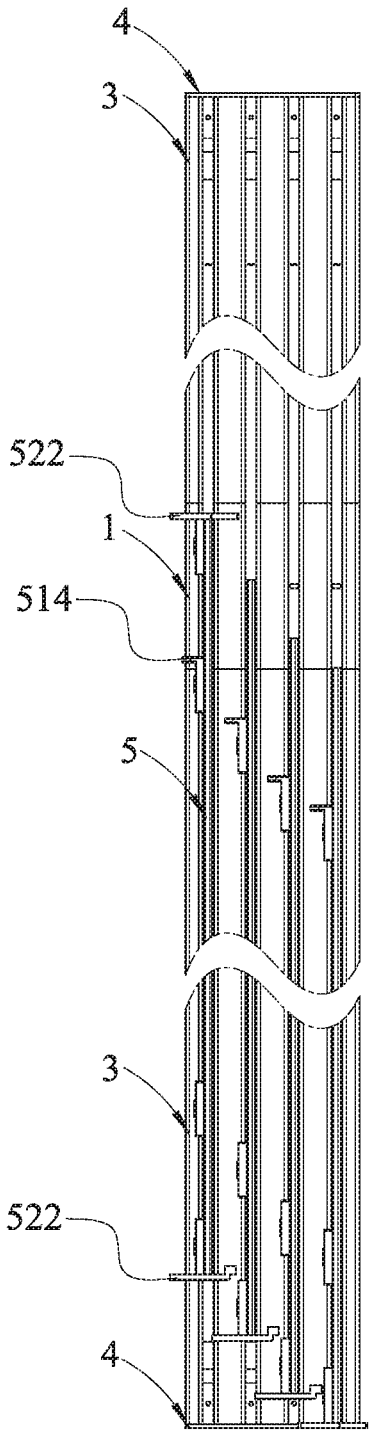
FIG. 8 is a bottom view of the track assembly in accordance with the preferred embodiment of the present invention.

Referring to the drawings and initially to FIGS. 1-8, a curtain track assembly in accordance with the preferred embodiment of the present invention comprises a base (or mount or support or grooved body) 1, a plurality of tracks (or sliding tracks) 2 connected with the base 1, and two slides (or sliding troughs) 3 slidably mounted on the tracks 2.

The base 1 is disposed between the two slides 3 and is provided with a plurality of slots 11. Each of the slots 11 of the base 1 includes a receiving section 111, two side openings 112, and a lower opening 113. The receiving section 111, the two side openings 112, and the lower opening 113 of each of the slots 11 are connected to each other. The receiving section 111 of each of the slots 11 defines two mounting areas 114. The lower opening 113 of each of the slots 11 has two fitting (or limit) ends 1131 extending upward.

The tracks 2 extend through the slots 11 of the base 1 from each of the two side openings 112 of each of the slots 11, and the base 1 is secured on each of the tracks 2. Each of the tracks 2 includes a receiving section 21, two side openings 22, and a lower opening 23. The receiving section 21, the two side openings 22, and the lower opening 23 of each of the tracks 2 are connected to each other. The lower opening 23 of each of the tracks 2 has two fitting ends 231 mounted in the two mounting areas 114 of each of the slots 11, such that the tracks 2 are parallel with each other.

Each of the two slides 3 is provided with a plurality of mounting portions 31 slidably mounted on the tracks 2. Each of the mounting portions 31 of each of the two slides 3 includes a receiving section 311, at least one side opening 312, and a lower opening 313. The receiving section 311, the at least one side opening 312, and the lower opening 313 of each of the two slides 3 are connected to each other. The receiving section 311 of each of the mounting portions 31 of each of the two slides 3 is mounted on each of the tracks 2 and defines two sliding areas 314 which are mounted on the two fitting ends 231 of each of the tracks 2, such that each of the two slides 3 is slidable on the tracks 2. The tracks 2 extend through the mounting portions 31 of each of the two slides 3 from the at least one side opening 312 of each of the mounting portions 31 of each of the two slides 3. The lower opening 313 of each of the mounting portions 31 of each of the two slides 3 has two sliding (or limit) ends 3131 extending upward. The lower opening 113 of each of the slots 11 of the base 1, the lower opening 23 of each of the tracks 2, and the lower opening 313 of each of the mounting portions 31 of each of the two slides 3 are connected to each other, such that the base 1, the tracks 2, and the two slides 3 are combined to construct a telescopically arranged curtain track assembly.

In practice, after the base 1 is fixed, the two slides 3 are directed pulled or pushed by the user, such that the two slides 3 are moved on the tracks 2 to expand or retract the curtain track assembly. When the two slides 3 are moved outward, the curtain track assembly is expanded.

In the preferred embodiment of the present invention, each of the tracks 2 is provided with two stop (or limit) portions 24, and each of the mounting portions 31 of each of the two slides 3 is provided with a resting portion 32 that is located in the receiving section 311 and is movable to touch or abut one of the two stop portions 24 of each of the tracks 2, to prevent each of the two slides 3 from being detached from the tracks 2. The receiving section 311 of each of the mounting portions 31 of each of the two slides 3 is provided with an operation space 3111 to receive and allow operation of one of the two stop portions 24 of each of the tracks 2.

In the preferred embodiment of the present invention, each of the two slides 3 has a side connected with an end cap 4. The end cap 4 is provided with a plurality of securing portions 41 inserted into and secured in the at least one side opening 312 of each of the mounting portions 31 of each of the two slides 3, such that the end cap 4 is secured to each of the two slides 3 and closes the at least one side opening 312 of each of the mounting portions 31 of each of the two slides 3.

In the preferred embodiment of the present invention, the end cap 4 is provided with a plurality of locking portions 42 mounted on each of the two slides 3 by a plurality of fastening members 43. Each of the two slides 3 is provided with a plurality of first fastening holes (or screw holes) 33, each of the locking portions 42 of the end cap 4 is provided with a plurality of second fastening holes 421, and each of the fastening members 43 extends through each of the second fastening holes 421 of each of the locking portions 42, and is screwed into each of the first fastening holes 33 of each of the two slides 3, such that each of the locking portions 42 of the end cap 4 is locked onto each of the two slides 3.

In the preferred embodiment of the present invention, each of the two slides 3 is provided with a plurality of clamping elements 34, and a plurality of clamping areas 35 arranged between the clamping elements 34. Each of the locking portions 42 of the end cap 4 is provided with an extending portion 422 received in one of the clamping areas 35 and clamped between two of the clamping elements 34.

In the preferred embodiment of the present invention, the base 1 is provided with a plurality of clamping members 13 located between the clamping elements 34 of the two slides 3. In assembly, the base 1 is to be mounted on a determined position which is provided with a plurality of rails (or iron bars). The clamping members 13 of the base 1 are locked onto the rails, and the clamping elements 34 of each of the two slides 3 are attached to the rails, such that the base 1 is secured to the rails, and each of the two slides 3 is movable on the rails. In such a manner, each of the two slides 3 is supported by the clamping elements 34 and the rails and will not be bent or deformed due to the gravity of the curtain.

In the preferred embodiment of the present invention, the base 1 is provided with a plurality of through holes 12, and each of the tracks 2 has a middle provided with a locking member 25 locked in one of the through holes 12 of the base 1, such that the base 1 is secured on the middle of each of the tracks 2.

In the preferred embodiment of the present invention, the curtain track assembly further comprises a plurality of sliding (or driving or drawing) seats 5 attached to the base 1, each of the tracks 2 and each of the two slides 3. Each of the sliding seats 5 includes a connecting member 52 and a plurality of extending members (or carriers or runners) 51 mounted on the connecting member 52. Each of the extending members 51 of each of the sliding seats 5 extends through and is slidable in one of the slots 11 of the base 1, one of the tracks 2, and one of the mounting portions 31 of each of the two slides 3.

In the preferred embodiment of the present invention, each of the extending members 51 of each of the sliding seats 5 is provided with an extension 511 extending toward two opposite sides thereof, and an extending piece 512 located under the extension 511, wherein the extension 511 is slidably mounted in the receiving section 111 of the base 1, the receiving section 21 of each of the tracks 2, and the receiving section 311 of each of the two slides 3, and is limited by the two fitting ends 1131 of the base 1, the two fitting ends 231 of each of the tracks 2, and the two sliding ends 3131 of each of the two slides 3, and the extending piece 512 extends from the lower opening 113 of the base 1, the lower opening 23 of each of the tracks 2, and the lower opening 313 of each of the two slides 3.

In the preferred embodiment of the present invention, each of the extending members 51 of each of the sliding seats 5 is further provided with a fitting section 513 located under the extending piece 512 and secured on the connecting member 52 by a plurality of fastening elements 53. The fitting section 513 of each of the extending members 51 is provided with a perforation 5131, the connecting member 52 of each of the sliding seats 5 is provided with a plurality of apertures 521, and each of the fastening elements 53 extends through the perforation 5131 of one of the extending members 51 and one of the apertures 521 of the connecting member 52, such that each of the extending members 51 of each of the sliding seats 5 is secured to the connecting member 52.

In the preferred embodiment of the present invention, the connecting member 52 of each of the sliding seats 5 is provided with a receiving groove 523 in which a connecting strip 524 is mounted, wherein the connecting strip 524 is connected with a curtain by a hook and loop fastener or a hanging hook.

Figure 9:
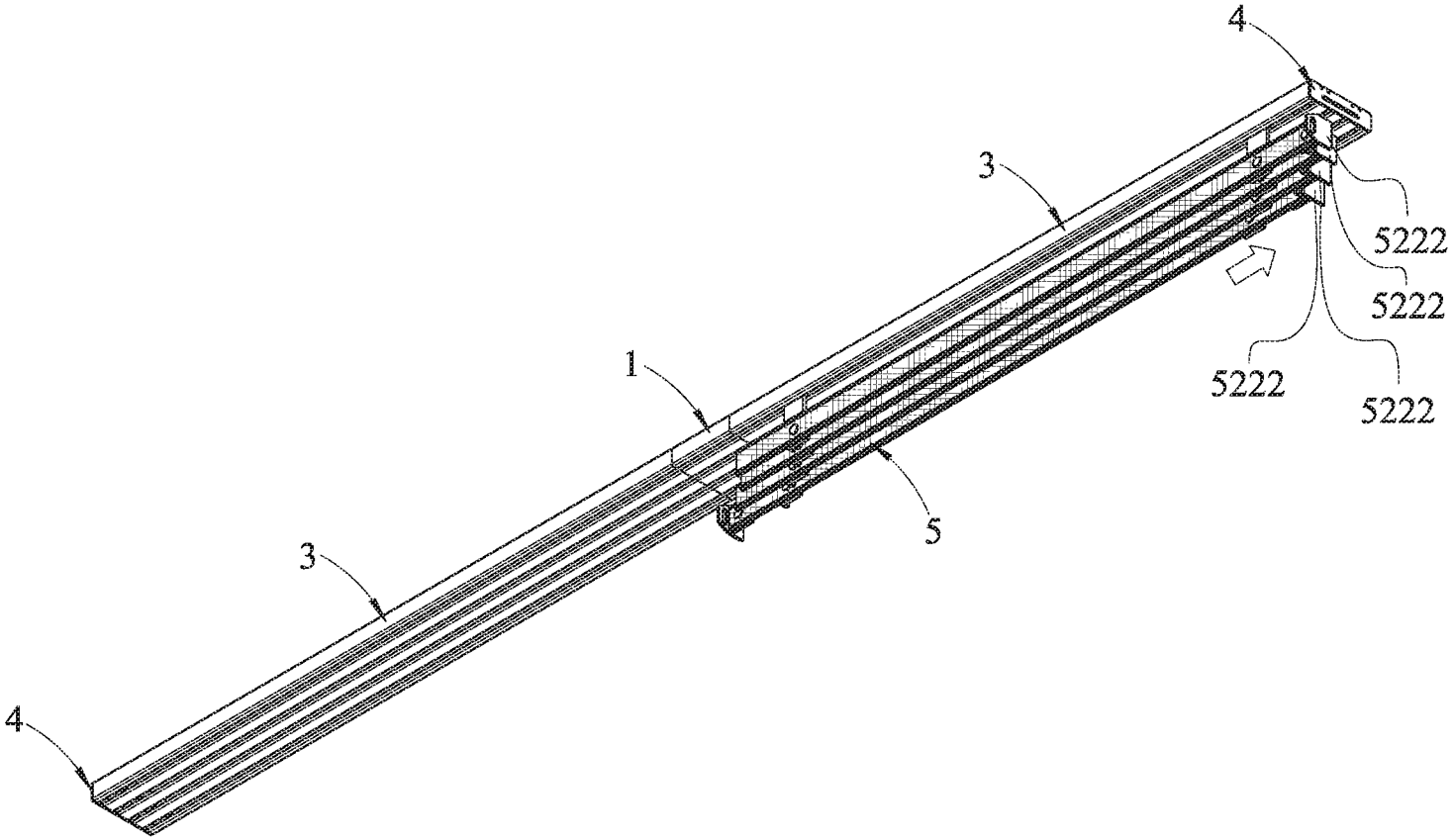
FIG. 9 is a perspective operational view of the track assembly in accordance with the preferred embodiment of the present invention.

In the preferred embodiment of the present invention, the connecting member 52 of each of the sliding seats 5 is connected with a linking piece 522 which is provided with a bore 5221, and one of the fastening elements 53 extends through the bore 5221 of the linking piece 522 and one of the apertures 521 of the connecting member 52, such that the linking piece 522 of each of the sliding seats 5 is secured to the connecting member 52. The linking piece 522 of each of the sliding seats 5 is provided with a push end 5222, wherein when the connecting members 52 of the sliding seats 5 are moved, the push end 5222 of the linking piece 522 of one of the sliding seats 5 is moved to press the push end 5222 of the linking piece 522 of another one of the sliding seats 5, such that the push ends 5222 of the linking pieces 522 of the sliding seats 5 are pushed mutually, and the connecting members 52 of the sliding seats 5 are driven and moved in the same direction simultaneously as shown in FIG. 9. Thus, the sliding seats 5 are driven and moved on the tracks 2.

Figure 10:
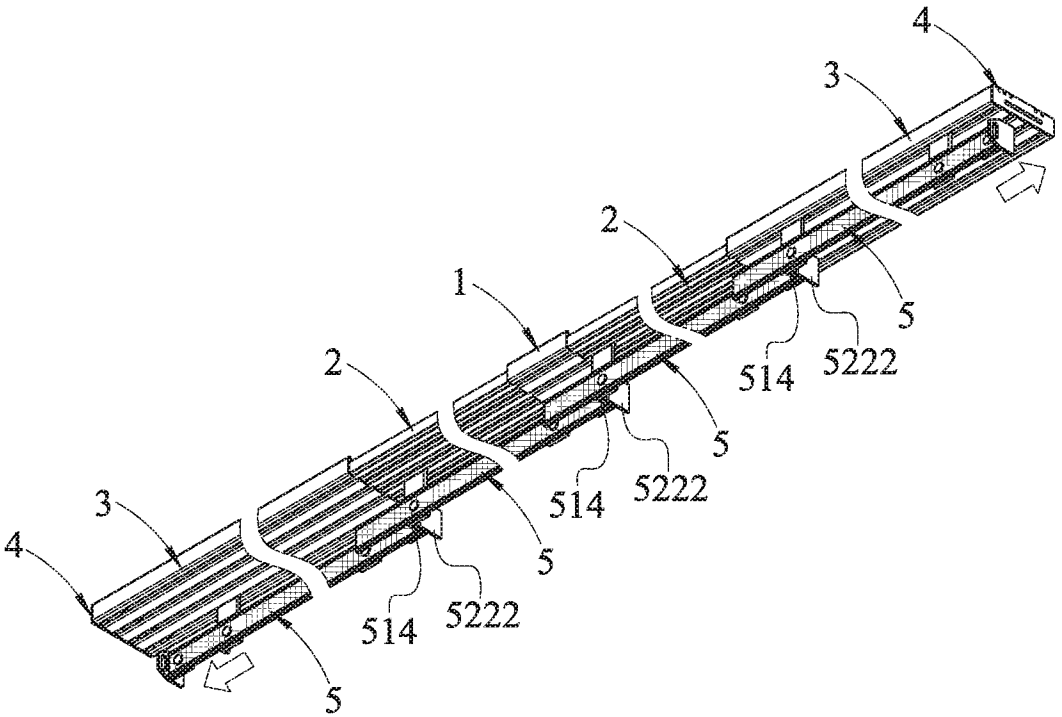
FIG. 10 is a perspective operational view of the track assembly in accordance with the preferred embodiment of the present invention.

In the preferred embodiment of the present invention, one of the extending members 51 of each of the sliding seats 5 is provided with a thrust end 514, wherein when the connecting members 52 of the sliding seats 5 are moved, the push end 5222 of the linking piece 522 of one of the sliding seats 5 is moved to press the thrust end 514 of one of the extending members 51 of another one of the sliding seats 5, such that the connecting members 52 of the sliding seats 5 are moved in the same direction simultaneously as shown in FIG. 10.

In the preferred embodiment of the present invention, the linking piece 522 of each of the sliding seats 5 is provided with a mounting hole 5223 which allows passage of a pull cord or allows hooking of an edge of the curtain, such that each of the sliding seats 5 is driven by the pull cord or the edge of the curtain. Preferably, only a front sliding seat 5 and a rear sliding seat 5 are provided with the mounting hole 5223.

In operation, referring to FIGS. 9 and 10 with reference to FIGS. 1-8, the sliding seats 5 are driven by the curtains, and the two slides 3 are pushed or pulled by the sliding seats 5, such that the two slides 3 are driven by the sliding seats 5 and moved on the tracks 2, so as to retract the curtain track assembly as shown in FIG. 9, or to expand the curtain track assembly as shown in FIG. 10.

Accordingly, the two slides 3 are moved in two directions during the assembling process so as to expand or retract the curtain track assembly according to the user's requirement. In addition, the curtain track assembly has a bidirectional adjusting function, thereby enhancing the versatility thereof.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the scope of the invention.

The invention claimed is:

1. A track assembly comprising:

a base;

a plurality of tracks connected with the base; and two slides slidably mounted on the tracks;

wherein:

the base is provided with a plurality of slots;

each of the slots of the base includes a receiving section, two side openings, and a lower opening;

the receiving section of each of the slots defines two mounting areas;

the lower opening of each of the slots has two fitting ends;

the tracks extend through the slots of the base;

the base is secured on each of the tracks;

each of the tracks includes a receiving section, two side openings, and a lower opening;

the lower opening of each of the tracks has two fitting ends mounted in the two mounting areas of each of the slots;

each of the two slides is provided with a plurality of mounting portions slidably mounted on the tracks;

each of the mounting portions of each of the two slides includes a receiving section, at least one side opening, and a lower opening;

the receiving section of each of the mounting portions of each of the two slides defines two sliding areas mounted on the two fitting ends of each of the tracks;

the tracks extend through the mounting portions of each of the two slides;

the lower opening of each of the mounting portions of each of the two slides has two sliding ends;

each of the tracks is provided with two stop portions;

each of the mounting portions of each of the two slides is provided with a resting portion that is movable to touch one of the two stop portions of each of the tracks; and the receiving section of each of the mounting portions of each of the two slides is provided with an operation space.

2. The track assembly of claim 1, wherein each of the two slides has a side connected with an end cap which is provided with a plurality of securing portions inserted into the at least one side opening of each of the mounting portions of each of the two slides.

3. The track assembly of claim 2, wherein:

the end cap is provided with a plurality of locking portions mounted on each of the two slides by a plurality of fastening members;

each of the two slides is provided with a plurality of first fastening holes;

each of the locking portions of the end cap is provided with a plurality of second fastening holes; and each of the fastening members extends through each of the second fastening holes of each of the locking portions, and is secured in each of the first fastening holes of each of the two slides.

4. The track assembly of claim 3, wherein:

each of the two slides is provided with a plurality of clamping elements, and a plurality of clamping areas arranged between the clamping elements; and each of the locking portions of the end cap is provided with an extending portion received in one of the clamping areas and clamped between two of the clamping elements.

5. The track assembly of claim 1, wherein the base is provided with a plurality of through holes, and each of the tracks has a middle provided with a locking member locked in one of the through holes of the base, such that the base is secured on the middle of each of the tracks.

6. The track assembly of claim 1, further comprising:

a plurality of sliding seats attached to the base, each of the tracks and each of the two slides;

wherein:

each of the sliding seats includes a connecting member and a plurality of extending members mounted on the connecting member; and each of the extending members of each of the sliding seats extends through one of the slots of the base, one of the tracks, and one of the mounting portions of each of the two slides.

7. The track assembly of claim 6, wherein:

each of the extending members of each of the sliding seats is provided with an extension and an extending piece;

the extension is slidably mounted in the receiving section of the base, the receiving section of each of the tracks, and the receiving section of each of the two slides, and is limited by the two fitting ends of the base, the two fitting ends of each of the tracks, and the two sliding ends of each of the two slides; and the extending piece extends from the lower opening of the base, the lower opening of each of the tracks, and the lower opening of each of the two slides.

8. The track assembly of claim 6, wherein:

each of the extending members of each of the sliding seats is further provided with a fitting section secured on the connecting member by a plurality of fastening elements;

the fitting section of each of the extending members is provided with a perforation;

the connecting member of each of the sliding seats is provided with a plurality of apertures; and each of the fastening elements extends through the perforation of one of the extending members and one of the apertures of the connecting member.

9. The track assembly of claim 6, wherein the the connecting member of each of the sliding seats is connected with a linking piece which is provided with a bore;

one of the fastening elements extends through the bore of the linking piece and one of the apertures of the connecting member;

the linking piece of each of the sliding seats is provided with a push end; and when the connecting members of the sliding seats are moved, the push end of the linking piece of one of the sliding seats is moved to press the push end of the linking piece of another one of the sliding seats, such that the push ends of the linking pieces of the sliding seats are pushed mutually, and the connecting members of the sliding seats are driven and moved in the same direction simultaneously.

10. The track assembly of claim 9, wherein:

one of the extending members of each of the sliding seats is provided with a thrust end; and when the connecting members of the sliding seats are moved, the push end of the linking piece of one of the sliding seats is moved to press the thrust end of one of the extending members of another one of the sliding seats, such that the connecting members of the sliding seats are moved in the same direction simultaneously.

* * * * *